US005879221A

United States Patent [19]

Barton et al.

[11] Patent Number: 5,879,221

[45] Date of Patent: Mar. 9, 1999

[54] TOY BULLDOZER WITH BLADE FLOAT MECHANISM

[75] Inventors: William M. Barton, Encinitas; Lonnie C. Pogue, San Diego; Daniel J. Aldred, Encinitas, all of Calif.

[73] Assignee: Rokenbok Toy Company, Cardiff, Calif.

[21] Appl. No.: 797,191

[22] Filed: Feb. 11, 1997

[51] Int. Cl.[6] ..... A63H 17/12

[52] U.S. Cl. ..... 446/427; 446/434; 446/456

[58] Field of Search ..... 446/424–428, 446/434, 456

[56] References Cited

U.S. PATENT DOCUMENTS

| | | | |
|---|---|---|---|
| 2,602,266 | 7/1952 | Preston | 446/434 |
| 3,400,488 | 9/1968 | Phillpott et al. | 469/244 |
| 3,482,046 | 12/1969 | Hughson et al. | 179/154 |
| 3,596,400 | 8/1971 | Cheng | 46/235 |
| 3,639,755 | 2/1972 | Wrege | 246/187 B |
| 3,738,057 | 6/1973 | Ogasawara | 446/425 |
| 3,744,181 | 7/1973 | Gagnon | 446/425 |
| 3,782,031 | 1/1974 | Byron | 46/244 R |
| 3,926,434 | 12/1975 | Cannon, Jr. | 373/86 B |
| 4,080,602 | 3/1978 | Hattori et al. | 343/225 |
| 4,087,799 | 5/1978 | Brouwer | 340/237.5 |
| 4,135,181 | 1/1979 | Bogacki et al. | 340/310 A |
| 4,171,468 | 10/1979 | Reiner | 179/15 AW |
| 4,334,221 | 6/1982 | Rosenhagen et al. | 340/825.72 |
| 4,571,211 | 2/1986 | Kuna | 446/434 |
| 4,817,948 | 4/1989 | Simonelli | 273/86 B |
| 5,073,750 | 12/1991 | Coron | 318/58.7 |
| 5,098,110 | 3/1992 | Yang | 273/438 |
| 5,148,159 | 9/1992 | Clark et al. | 340/825.22 |
| 5,364,108 | 11/1994 | Esnouf | 273/430 |
| 5,435,768 | 7/1995 | Dunleavy | 446/427 |
| 5,452,901 | 9/1995 | Nakada et al. | 273/310 |
| 5,471,668 | 11/1995 | Soenen et al. | 455/352 |
| 5,474,486 | 12/1995 | Chilton et al. | 446/456 |

*Primary Examiner*—Kien T. Nguyen
*Assistant Examiner*—Jeffrey D. Carlson
*Attorney, Agent, or Firm*—Ellsworth R. Roston; Fulwider Patton Lee & Utecht, LLP

[57] ABSTRACT

A remotely-controllable motorized toy bulldozer vehicle has a highly-maneuverable skid steering system and a motorized blade lift mechanism pivotally secured to the chassis of the vehicle operative to permit the blade to free float at its lower positions but operative in the elevated position of such blade to positively hold it up at a set level. A hitch is provided for hitching to a trailer and hitch driver is responsive to such blade being lifted to higher elevations to automatically unhitch the hitch.

27 Claims, 9 Drawing Sheets

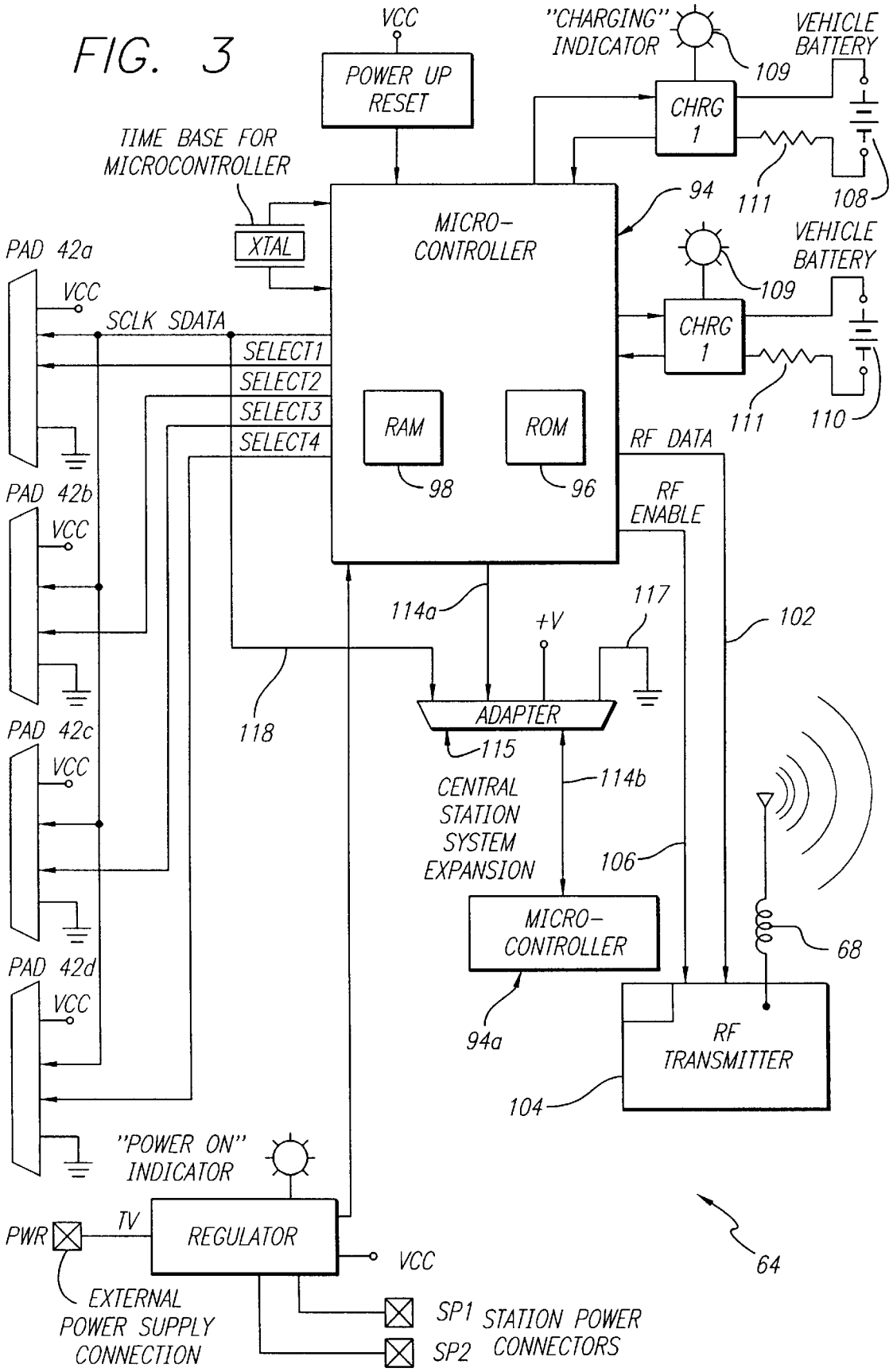
FIG. 3
VCC
POWER UP RESET
"CHARGING" INDICATOR
VEHICLE BATTERY
109
CHRG 1
TIME BASE FOR MICROCONTROLLER
XTAL
MICRO-CONTROLLER
94
111
108
VEHICLE BATTERY
109
CHRG 1
111
110
PAD 42a
VCC
SCLK SDATA
SELECT1
SELECT2
SELECT3
SELECT4
RAM
ROM
98
96
RF DATA
RF ENABLE
PAD 42b
VCC
114a
+V
117
102
118
ADAPTER
115
PAD 42c
VCC
CENTRAL STATION SYSTEM EXPANSION
114b
106
MICRO-CONTROLLER
68
PAD 42d
VCC
94a
RF TRANSMITTER
104
"POWER ON" INDICATOR
PWR
TV
REGULATOR
VCC
64
EXTERNAL POWER SUPPLY CONNECTION
SP1
SP2
STATION POWER CONNECTORS

VCC
POWER UP RESET
VCC 122
12
TIME BASE FOR MICROCONTROLLER
134
XTAL
MICRO-CONTROLLER
MOTOR 1
28
RAM
ROM
TRANSISTOR DRIVER
4
VEHICLE ADDRESS SELECT
126
124
120
128
130
MOTOR 2
30
132
TRANSISTOR DRIVER
4
120
MOTOR 3
32
TRANSISTOR DRIVER
4
120
MOTOR 4
33
TRANSISTOR DRIVER
4
120
POWER ON
VCC
BATTERY
4.5V
69
RF POWER MANAGEMENT
GND
RF RECEIVER
121

TOY BULLDOZER WITH BLADE FLOAT MECHANISM

BACKGROUND OF THE INVENTION

1. Field of the Invention

This invention relates to a system for pleasurable use by people of all ages with youthful minds in operating remotely controlled vehicles simultaneously in a somewhat confined area. In the system of this invention, the vehicles can be remotely controlled to perform competitive or cooperative tasks. The system includes control pads for operation by the users, vehicles remotely controlled in accordance with the operation of the control pads and a central control station for coordinating the operation of the control pads and the vehicles. In addition to the inventive aspects of the system, each of the control pads, the central control station and the vehicles includes features of an inventive nature. The system of this invention also includes stationary plants (e.g. power plants and elevators) which are controlled by the operation of the control pads. The invention additionally relates to methods including methods for controlling the operation of the vehicles on a remotely controlled basis.

More specifically, this invention relates to remotely controlled vehicles having inventive features such as toy self-loading dump trucks, trailers, forklifts and bulldozers that can be operated to mimic the operation of similar full-size vehicles by employing highly-maneuverable skid steering, having automatic tow hitch actuation mechanisms and having motorized accessories for scooping up transportable elements, transferring the transportable elements to a hopper, automatically activating the hopper to dump the transportable elements, for gripping, lifting and translating transportable elements, and for pushing transportable elements along a surface.

2. Description of the Related Art

Various types of toy systems exist, and have existed for some time, in which vehicles are moved on a remotely controlled basis. Examples of a vehicle in such a system are an automobile, airplane, truck, water vehicle or construction vehicle. In most such systems, however, the functions and activities that the vehicle is capable of are limited to merely maneuvering a vehicle about on the ground, in the air or in the water. Other types of toy systems involve the use of blocks for building structures. These blocks often include structure for providing an interlocking relationship between abutting blocks. In this way, elaborate structures can be created by users with creative minds. Such structures are generally built by hand.

Experience has proven that there is a desirability, and even a need, for play systems in which vehicles are remotely operated to perform functions other than merely being steered or maneuvered through a path of travel. For example, there exists a desire for a play system in which the remotely controlled vehicles have the capability of transporting elements such as building blocks maneuverable into position to build a toy or other structure. It is desirable that such systems employ a plurality of vehicles remotely controlled by switches in hand-held control pads so that users can compete against one another in performing various tasks such as moving building blocks or marbles.

Co-pending application Ser. No. 08/580,753 filed by John J. Crane on Dec. 29, 1995, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit or pad providing a control of a different function in the individual one of the remotely controlled vehicles. Each of the remotely controlled vehicles in the system disclosed an claimed in application Ser. No. 08/580,753 can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the system disclosed and claimed in application Ser. No. 08/580,753, switches in pads control the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles) or blocks.

When sequentially and cyclically interrogated by a central station, each pad in the system disclosed and claimed in application Ser. No. 08/580,753 sends through wires to the central station signals indicating the switch closures in such pad. Such station produces first binary signals addressing the vehicle selected by such pad and second binary signals identifying the motor control operations in such vehicle. Thereafter the switches identifying in such pad the control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signal and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) in the system disclosed and claimed in application Ser. No. 08/580,753 so as to increase the number of pads controlling the vehicles. Stationary accessories (e.g. elevator) connected by wires to the central station become operative when selected by the pads.

Co-pending application Ser. No. 08/763,678 filed by William M. Barton, Jr., Peter C. DeAngelis and Paul Eichen on Dec. 11, 1996 for a "System For And Method Of Selectively Providing The Operation Of Toy Vehicles" and assigned of record to the assignee of record of this application discloses and claims a system wherein a key in a vehicle socket closes contacts to reset a vehicle microcontroller to a neutral state. Ribs disposed in a particular pattern in the key operate switches in a particular pattern in the vehicle to provide an address for the vehicle with the vehicle inactive but powered. When the vehicle receives such individual address from an individual one of the pads in a plurality within a first particular time period thereafter, the vehicle is operated by commands from such pad. Such individual pad operates such vehicle as long as such vehicle receives commands from such individual pad within the first particular period after the previous command from such individual pad. During this period, the vehicle has a first illumination to indicate that it is being operated.

When the individual pad of the system disclosed and claimed in application Ser. No. 08/763,678 fails to provide commands to such vehicle within such first particular time period, the vehicle becomes inactive but powered and provides a second illumination. While inactive but powered, the vehicle can be addressed and subsequently commanded by any pad including the individual pad, which thereafter commands the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. If the vehicle becomes de-activated and not illuminated, the key can thereafter be actuated to operate the vehicle to the inactive but powered state.

Co-pending application Ser. No. 08/696,263, filed by Peter C. DeAngelis on Aug. 13, 1996 for a "System And Method Of Controlling The Operation Of Toys" and assigned of record to the assignee of record of this application discloses and claims a system wherein individual ones of pads remotely control the operation of selective ones of vehicles. In each pad, (a) at least a first control provides for the selection of one of the vehicles, (b) second controls provide for the movement of the selected vehicle and (c) third controls provide for the operation of working members (e.g. pivotable bins) in the selected vehicle. Each pad provides a carrier signal, preferably common with the carrier signals from the other pads. Each pad modulates the carrier signal in accordance with the operation of the pad controls. The first control in each pad provides an address distinctive to the selected one of the vehicles and modulates the carrier signal in accordance with such address.

Each pad of the system disclosed and claimed in application Ser. No. 08/696,263 sends the modulated carrier signals to the vehicles in a pseudo random pattern, different for each pad, with respect to time. Each vehicle demodulates the carrier signals to recover the address distinctive to such vehicle. Each vehicle then provides a movement of such vehicle and an operation of the working members in such vehicle in accordance with the modulations provided in the carrier signal by the operation of the second and third controls in the pads selecting such vehicle. Each vehicle is controlled by an individual one of the pads for the time period that such pad sends control signals to such vehicle within a particular period of time from the last transmission of such control signals to such vehicle. Thereafter such vehicle can be selected by such pad or by another pad.

What has been needed, and heretofore unavailable, is a toy system including vehicles remotely operated to accomplish tasks such as lifting, scooping, dumping, leveling, pushing, hauling and otherwise transporting suitably sized materials and towing of trailers carrying such material, or other vehicles, in combination to create a miniature community or industrial environment, thus providing a person having a youthful mind with the opportunity to employ a remotely-controlled system of vehicles and mechanisms to accomplish these tasks and others within a reduced-scale, industrial environment in cooperation or competition with other individuals in a pleasurable manner.

SUMMARY OF THE INVENTION

The toy vehicle disclosed herein comprises a wheeled, highly-maneuverable, motor driven, skid steering, bulldozer vehicle with a freely floating blade capable of following the contours of the terrain and having the capability to releasably tow other vehicles and which is compatible with a sophisticated remote-control system. Either single or dual motors are employed to drive the wheels and skid steering while only a single additional motor is employed to drive the blade lift and hitching mechanisms. Another motor is shown in the disclosed embodiment for driving the gripping mechanism.

The remotely operated toy bulldozer of the present invention provides a great degree of maneuverability and capability for manipulating materials in a manner which faithfully simulates work at a grading or construction site. The blade of the toy bulldozer may float to a level below the horizontal plane and is free to move upwardly and downwardly relative to the body of the bulldozer to enable the blade to closely follow the contour of the surface over which the bulldozer is traveling. For moving material from a stacked or piled position, the blade may be elevated to hold the blade at a set elevation relative to the body of the vehicle. As an additional feature, the same mechanism which supports the blade may be utilized to automatically actuate a hitch for hitching and unhitching a towed trailer or the like. The unique ability of the blade of the toy bulldozer of the present invention to float upwardly in all modes of operation permits the operator of the bulldozer to actuate the hitching mechanism by manually rotating the blade upwardly. This allows the hitch to be operated when the toy bulldozer is not powered.

The toy bulldozer vehicle is for use as part of a toy system for use by people of all ages with youthful minds. The system provides for a simultaneous control by each player of an individual one of a plurality of remotely controlled vehicles, including the bulldozer vehicle. This control is provided by the operation by each such player of switches in a hand-held unit or control pad, the operation of each switch in such hand-held unit providing a control of a different function in the individual one of the remotely controlled vehicles.

Each of the remotely controlled vehicles in the system of this invention can be operated in a competitive relationship with others of the remotely controlled vehicles or in a cooperative relationship with others of the remotely controlled vehicles. The vehicles can be constructed to pick up and transport elements such as blocks or marbles or other transportable elements and to deposit such elements at displaced positions.

When manually closed in one embodiment of the invention, switches in control pads control the selection of toy vehicles and the operation of motors for moving the vehicles forwardly, rearwardly to the left and to the right and moving upwardly and downwardly (and rightwardly and leftwardly) a receptacle for holding, lifting and transporting transportable elements (e.g. marbles).

When sequentially and cyclically interrogated by a central control station, each control pad sends through wires to the station signals indicating the switch closures in such control pad. Such station produces first binary signals addressing the vehicle selected by such control pad and second binary signals identifying the control operations in such vehicle. Thereafter the switches identifying in such control pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a control pad for a particular period of time, the vehicle selected by such control pad becomes available for selection by another control pad and such control pad can select that vehicle or another vehicle.

A cable may couple two (2) central control stations (one as a master and the other as a slave) to increase the number of control pads controlling by the vehicles. Stationary accessories (e.g. elevator) connected by wires to the central control station become operative when selected by the control pads.

These and other features and advantages of the invention will become apparent from the following detailed description when taken in conjunction with the following exemplary drawings.

BRIEF DESCRIPTION OF THE DRAWINGS

In the drawings, where like reference numerals indicate like or similar components, elements and features across the several figures:

FIG. 3 is a schematic diagram, primarily in block form, of the different features included in a central control station included in the system shown in FIG. 1;

DETAILED DESCRIPTION OF THE PREFERRED EMBODIMENT

The drawings will now be described in more detail, wherein like referenced numerals refer to like or corresponding elements among the several drawings. Moreover, reference may be made to U.S. patent applications Ser. No. 08/580,753, Ser. No. 08/763,678 and Ser. No. 08/696,263, which are hereby incorporated in their entirety.

Figure 1:
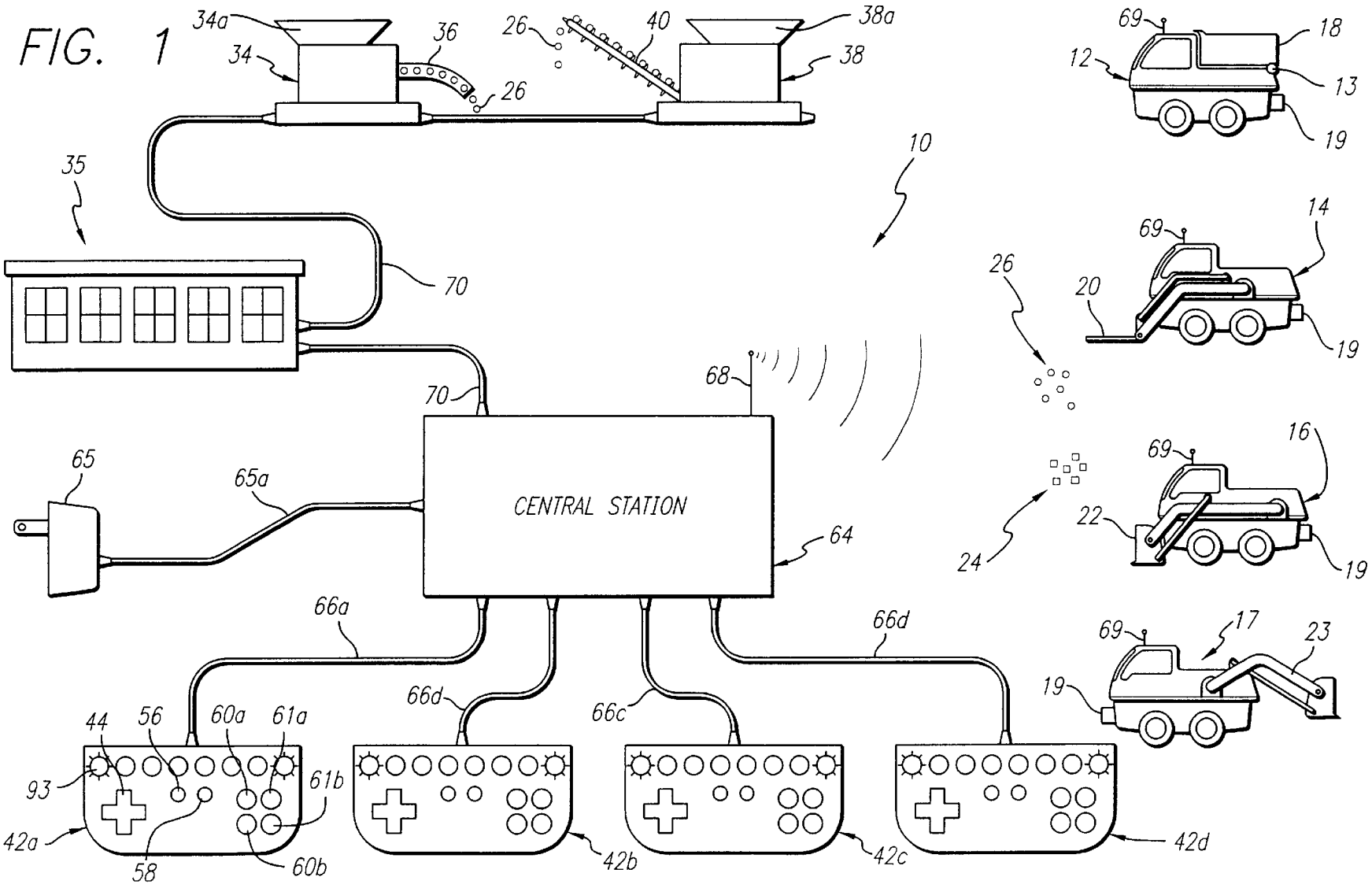
FIG. 1 is a schematic diagram of a system constituting one embodiment of the remote-control system invention.

In one embodiment of the invention, a system generally indicated at 10 in FIG. 1 is provided for controlling the selection and operation of a plurality of toy vehicles. Illustrative examples of toy vehicles constitute a dump truck, generally indicated at 12, a fork lift, generally indicated at 14, a skip loader, generally indicated at 16 and another form of skip loader, generally indicated at 17. The toy vehicles such as the dump truck vehicle 12, the fork lift 14 and the skip loaders 16 and 17 are simplified small scale replicas of corresponding full-size commercial units. For example, the dump truck vehicle 12 may include a working or transport member such as a pivotable tip up bin or container 18; the fork lift 14 may include a working or transport member such as a pivotable platform 20; the skip loader 16 may include a working or transport member such as a pivotable bucket 22 disposed at the front end of the skip loader; the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the toy vehicles 12, 14, 16 and 17 may also have a trailer hitch 19 mounted on the front or rear of the vehicle for hooking a hitch member of another vehicle, such as trailer (not shown) to the hitch 19 of the vehicles 12, 14, 16 and 17. The trailer hitch 19 may be remotely controlled in similar fashion to the working or transport member of the toy vehicle. Alternatively, the trailer hitch may be mechanically interconnected with the working or transport member such that remote control of the working or transport member also controls the trailer hitch 19.

Each of the dump truck 12, the fork lift 14, the skip loaders 16 and 17, and the bulldozer may include a plurality of motors. For example, the dump truck 12 includes a pair of reversible motors 28 and 30 (FIG. 4) to move the dump truck vehicle forwardly or rearwardly and to pivot the vehicle to the right or to the left. The motor 28 drives the movement of the front and rear wheels on the left side of the dump truck 12, and the motor 30 drives the front and rear wheels on the right side of the dump truck 12.

When the motors 28 and 30 are simultaneously operated in one direction, the dump truck 12 moves forwardly. The dump truck 12 moves rearwardly when the motors 28 and 30 are moved in the opposite direction. The dump truck 12 turns toward the right when the motor 30 is operated without simultaneous operation of the motor 28. The dump truck 12 turns toward the right when the motor 28 is operated without a simultaneous operation of the motor 30.

The dump truck 12 spins to the right when the motor 30 operates to move the vehicle forwardly at the same time that the motor 28 operates to move the vehicle rearwardly. The dump truck 12 spins to the left when the motors 28, 30 are operated in directions opposite to the operations of the motors in spinning the vehicle to the right.

Another reversible motor 32 in the dump truck 12 operates in one direction to pivot the bin 18 about its rearward hinge 13 upwardly and in the other direction to pivot the bin downwardly. In another embodiment, continued rotation of the motor 32 to pivot the bin 18 in an upwardly direction may cause the trailer hitch 19 to open. When the motor 32 is operated in the other direction, the trailer hitch 19 closes and the bin 18 pivots downwardly. An additional motor 33 may operated in one direction to turn the bin 18 to the left and in the other direction to turn the bin 18 to the right.

The construction of the motors 28, 30, 32 and 33 and the disposition of the motors and controls in the dump truck 12 to operate the dump truck are considered to be well known in the art. The fork lift 14, the skip loaders 16 and 17, and the bulldozer may include motors similar to those described above for the dump truck 12.

The system 10 may also include remotely-controlled, motorized stationary plants or accessories. For example, it may include a remotely-controlled motorized pumping station, generally indicated at 34 (FIG. 1), and driven by a pumping motor responsive to a control (not shown), for pumping elements such as the marbles 26 from a hopper 34a through a conduit 36. The system may also include a remotely-controlled motorized conveyor, generally indicated at 38, and driven by a conveyor motor responsive to a control (not shown), for moving the elements such as the marbles 26 from a hopper 38*a* upwardly on a ramp 40. When the marbles 26 reach the top of the ramp 40, the elements such as the marbles 26 may fall into the bin 18 in the dump truck vehicle 12 or into the bin 22 in the skip loader 16 or 17. For the purposes of this application, the construction of the pumping station 34 and the conveyor 38 may be considered to be within the purview of a person of ordinary skill in the art. Accessories or stationary plants 34 and 38 may be connected to the central station 64 either directly or through a junction box such as miniature building 35 as shown in FIG. 1.

The system 10 may also include a plurality of hand held control pads, generally indicated at 42*a*, 42*b*, 42*c* and 42*d* (FIG. 1). Each of such control pads may have a substantially identical construction. Each of the control pads may include a plurality of actuatable buttons. For example, each of the control pads may include 4-way cruciform buttons 44 configured with four wings disposed over respective control buttons 44 arranged to drive individual ones of a plurality of switches 46, 48, 50, and 52 (FIG. 2).

One wing of the button 44 may be depressed to engage the button associated with the switch 46 to close the circuit in one direction through the motor 28 (FIG. 4) moving the selected one of the vehicle 12 forwardly. Similarly, the opposite wing of button 44 may be depressed, to close the switch 48 to close the circuit in the opposite direction through motor 28 (FIG. 4) moving the vehicle 12 rearwardly. The selective depression of the left and right segments of the button 44 closes the respective switches 52 and 50, in turn, respectively closing the circuit in one direction then the opposite direction through the respective motors 28 and 30 respectively turning the selected vehicle 12 toward the left and the right about its vertical axis.

It will be appreciated that the buttons 44 may be tilted in one diagonal direction or the other by simultaneously pressing two neighboring wings of buttons 44 to simultaneously close respective neighboring pairs of switches 46 (forward) & 50 (right) to obtain a simultaneous movement of the vehicle 12 forwardly and to the right. However, a simultaneous actuation of the top and bottom wings of the button 44 will not have any effect since such actuations represent contradictory commands. This is also true of a simultaneous actuation of the left and right wings of the button 44.

Figure 2:
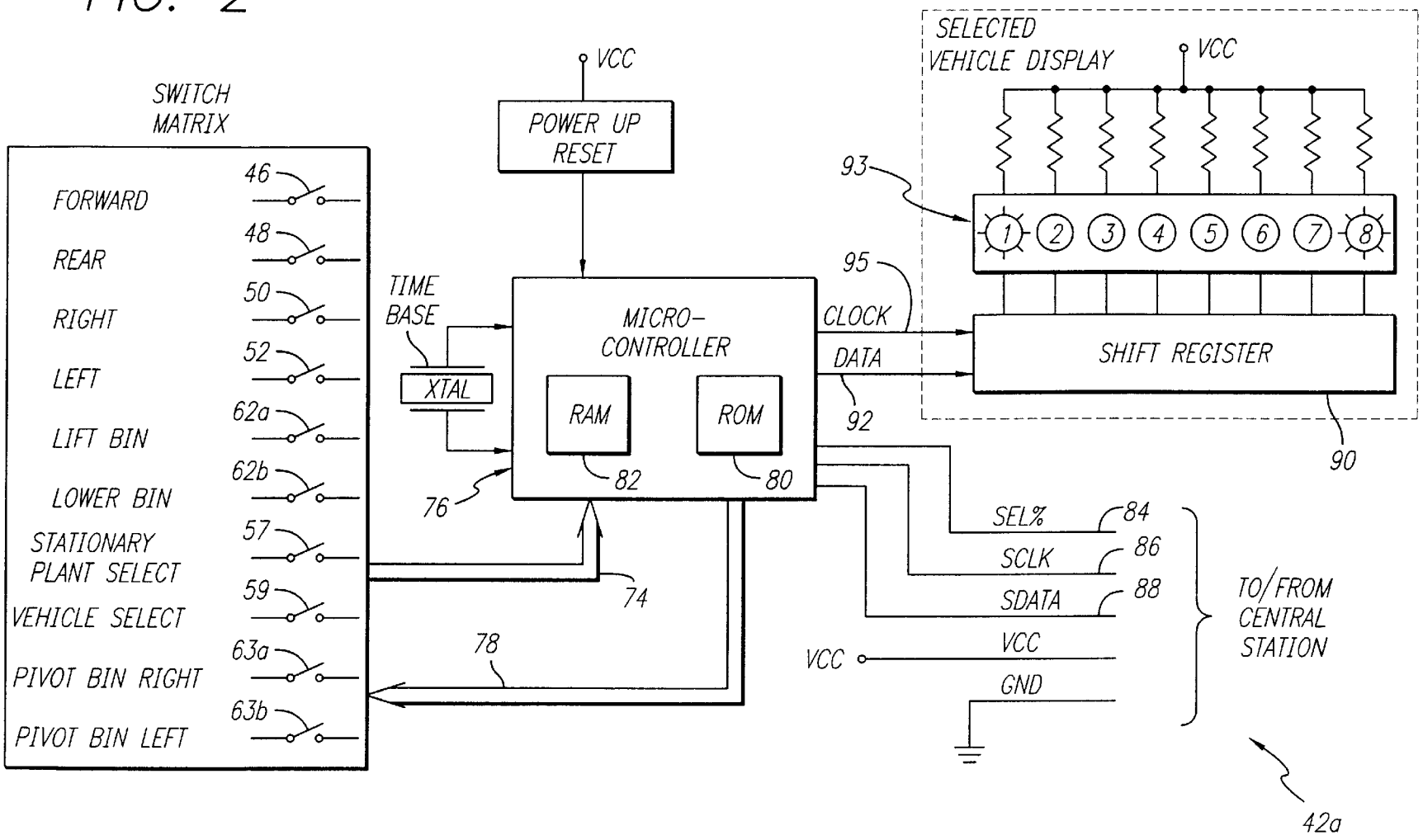
FIG. 2 is a schematic diagram, primarily in block form, of a control pad control system incorporated in the system shown in FIG. 1.

Each of the control pads 42*a*, 44*b*, 42*c* and 42*d* includes a button 56 (FIG. 1) connected to switch 57 (FIG. 2). Successive depressions of the button 56 within a particular period of time cause different ones of the stationary accessories or plants such as pumping station 34 and conveyer 38 to become energized. For example, a first depression of the button 56 in one of the control pads 42*a*, 42*b*, 42*c* and 42*d* may cause the pumping station 34 to be energized and a second depression of the button 56 within the particular period of time in such control pad may cause the conveyor 38 to be energized. When other stationary accessories are included in the system 10, each may be individually energized by depressing the button 56 a selective number of times within the particular period of time. When the button 56 is depressed twice within the particular period of time, the energizing of the pumping station 34 is released and the conveyor 38 is energized. This energizing of a selective one of the stationary accessories occurs at the end of the particular period of time.

A vehicle selection button 58 is provided in each of the control pads 42*a*, 42*b*, 42*c* and 42*d* to select one of the vehicles 12, 14, 16 and 17. The individual one of the vehicles 12, 14, 16 and 17 selected at any instant by each of the control pads 42*a*, 42*b*, 42*c* and 42*d* is dependent upon the number of times that the button is depressed in that control pad within a particular period of time. For example, one (1) depression of the button 58 may cause the dump truck vehicle 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the control pad 42 to count the number of depressions of the button 58 within the particular period of time. The count is converted into a plurality of binary signals indicating the count. The count is provided at the end of the particular period of time. Each individual count provides for a selection of a different one of the vehicles 12, 14, 16 and 17. The count representative of the selection of one of the vehicles 12, 14, 16 and 17 is maintained in a memory, which may be located either in the control pads 42*a*, 42*b*, 42*c* and 42*d*, or in the central station 64.

The control pads 42*a*, 42*b*, 42*c* and 42*d* include buttons 60*a* and 60*b*. When depressed, the buttons 60*a* and 60*b* respectively close switches 62*a* and 62*b* in FIG. 2. The closure of the switch 62*a* is instrumental in producing an operation of the motor 32 to lift the bin 18 in the dump truck 12 when the dump truck has been selected by the proper number of depressions of the button 58. In like manner, when the dump truck 12 has been selected by the proper number of depressions of the switch 58, closure of the switch 62*b* causes the bin 18 in the dump truck 12 to move downwardly as a result of the operation of the motor 32 in the reverse direction.

It will be appreciated that other controls may be included in each of the control pads 42*a*, 42*b*, 42*c* and 42*d*. For example, buttons 61*a* and 61*b* may be included in each of the control pads 42*a*, 42*b*, 42*c* and 42*d* (FIG. 1) which operate upon depression to close respective second accessory switches 63*a* and 63*b* (FIG. 2) to pivot the bin 18 to the right or left when the vehicle 12 has been selected. Such pivotal movements of bin 18 facilitate loading, transportation and unloading of transportable elements such as marbles 26 or blocks 24. It will be appreciated that different combinations of buttons may be actuated simultaneously to produce different combinations of motions. For example, a bin in a selected one of the vehicles may be moved at the same time that the selected one of the vehicles is moved.

A central control station, generally indicated at 64 in FIG. 1, processes the signals from the individual ones of the control pads 42*a*, 42*b*, 42*c* and 42*d* and sends the processed signals to the vehicles 12, 14, 16 and 17 when the button 58 on an individual one of the control pads has been depressed to indicate that the information form the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16 and 17 to perform individual ones of the functions directed by the depression of the different buttons on the individual ones of the control pads. When the commands from the individual ones of the control pads 42*a*, 42*b*, 42*c* and 42*d* are to pass to the stationary accessories 34 and 38 as a result of the depression of the buttons 56 on the individual ones of the pads, the central station process the commands and sends signals through cables 70 to the selected ones of the stationary accessories.

FIG. 2 shows the construction of the control pad 42*a* in additional detail. It will be appreciated that each of the control pads 42*b*, 42*c* and 42*d* may be constructed in a substantially identical manner to that shown in FIG. 2. As shown in FIG. 2, the control pad 42*a* includes the switches 46, 48, 50 and 52 and the switches 57, 59, 62*a*, 62*b*, 63*a* and 63*b*. Buses 74 are shown as directing signals from the switches 46, 48, 50, 52, 57, 59, 62*a*, 62*b*, 63*a* and 63*b* to a microcontroller, generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the control pad 42*a* provide indications of whether or not they have been closed. The random access memory 82 may receive this sequence from the read only memory 80 and may store indications of whether or not the switches in the particular sequence have been closed for each individual one of the control pads 42*a*, 42*b*, 42*c* and 42*d*.

The control pad 42*a* in FIG. 2 receives the interrogating signals from the central control station 64 through a line 84. These interrogating signals are not synchronized by clock signals on a line 86. Each of the interrogating signals intended for the control pad 42*a* may be identified by an address individual to such control pad. When the control pad 42*a* receives such interrogating signals, it sends to the central control station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the control pad 42*a* selects one of the vehicles 12, 14, 16 and 17 in accordance with the number of closings of the switch 59. As the user of the control pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED), generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the control pad 42*a* has selected at such instant.

The central control station 64 is shown in additional detail in FIG. 3. It includes a microcontroller, generally indicated at 94, having a read only memory (ROM) 96 and a random access memory (RAM) 98. As with the memories in the microcontroller 76 in the control pad 42*a*, the read only memory 96 stores permanent information and the random access memory 98 stores volatile (or impermanent) information. For example, the read only memory 96 sequentially selects successive ones of the control pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the control pads 42*a*, 42*b*, 42*c* and 42*d* is being interrogated at each instant, it knows the individual one of the control pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the control pad 42*a* can provide an address indicating the control pad 42*a* when the microcontroller sends the binary signals relating to the status of the switches 46, 48, 50 and 52 and the switches 57, 59, 62*a*, 62*b*, 63*a* and 63*b* to the central control station 64.

As an example of the information stored in the random access memory 98 in FIG. 3, the memory stores information relating to each pairing between an individual one of the control pads 42*a*, 42*b*, 42*c* and 42*d* and a selective one of the vehicles 12, 14, 16 and 17 in FIG. 1 and between each individual one of such control pads and a selective one of the stationary accessories 34 and 38. The random access memory 98 also stores the status of the operation of the switches 46, 48, 50 and 52 for each control pad and the operation of the switches 57, 59, 62*a*, 62*b*, 63*a* and 63*b* for each control pad.

When the central control station 64 receives from the control pad 42*a* the signals indicating the closure (or the lack of closure) of the switches 46, 48, 50 and 52 and the switches 57, 59, 62*a*, 62*b*, 63*a* and 63*b*, the central control station retrieves from the read only memory 96 the address of the individual one of the vehicles indicated by the closures of the switch 59 in the control pad. The central control station may also retrieve the address of the control pad 42*a* from the read only memory 96.

The central control station 64 then formulates in binary form a composite address identifying the control pad 42*a* and the selected one of the vehicles 12, 14, 16 and 17 and stores this composite address in the random access memory 98. The central control station 64 then provides a packet or sequence of signals in binary form including the composite address and including the status of the opening and closing of each of the switches in the control pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the control pad 42*a* is introduced through a line 102 (FIG. 3) to a radio frequency transmitter 104 in the central control station 64. The radio frequency transmitter 104 is enabled by a signal passing through a line 106 from the microcontroller 94.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central control station 64 will respond to such packet of signals.

The microcontroller 94 stores in the random access memory 98 the individual ones of the vehicles such as the vehicles 12, 14, 16 and 17 being energized at each instant by the individual ones of the control pads 42*a*, 42*b*, 42*c* and 42*d*. Because of this, the central control station 64 is able to prevent the interrogated one of the control pads 42*a*, 42*b*, 42*c* and 42*d* from selecting one of the energized vehicles. Thus, for example, if the vehicle 14 is being energized by one of the control pads 42*a*, 42*b*, 42*c* and 42*d* at a particular instant, a first depression of the button 58 in the control pad being interrogated at that instant will cause the vehicle 12 to be initially selected and a second depression of the button by such control pad will cause the vehicle 14 to be skipped and the vehicle 16 to be selected.

Furthermore, in the example above where the control pad 42*a* has previously selected the vehicle 14, the microcomputer 94 in the central control station 64 will cause the vehicle 14 to be released when the control pad 42*a* selects any of the vehicles 12, 16 or 17. When the vehicle 14 becomes released, it becomes available immediately thereafter to be selected by any one of the control pads 42*a*, 42*b*, 42*c* and 42*d*. The release of the vehicle 14 by the control pad 42*a* and the coupling between the control pad 42*a* and a selected one of the vehicles 12, 14, 16 and 17 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central control station 64 because the central control station may receive AC power from a wall socket via a transformer 65 and cable 65*a* (FIG. 1). The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged. Charging capability is additionally provided to system 10 by any of a number of other possible configurations including charging station locations in the junction box station 35 or as separate stationary plants or other types of accessories such as those depicted by 34 and 38 (FIG. 1) any of which may be placed conveniently throughout the system 10 as desired by the users.

Each central control station 64 may have the capabilities of servicing only a limited number of control pads. For example, each central control station 64 may have the capabilities of servicing only the four (4) control pads 42*a*, 42*b*, 42*c* and 42*d*. It may sometimes happen that the users of the system elect to service more than four (4) control pads. Under such circumstances, the microcontroller 94 in the central control station 64 and a microcontroller, generally indicated at 94*a*, in a second central control station corresponding to the central control station 64 may be connected by cables 114*a* and 114*b* to an adaptor, generally indicated at 115.

One end of the cable 114*b* is constructed so as to be connected to a ground 117 in the adaptor 115. This ground operates upon the central control station to which it is connected so that such central control station is a slave to, or subservient to, the other central control station. For example, the ground 117 in the adaptor 115 may be connected to the microcomputer 94*a* so that the central control station including the microcomputer 94*a* is a slave to the central control station 64. When this occurs, the microcontroller 94 in the central control station 64 serves as the master for processing the information relating to the four (4) control pads and the four (4) vehicles in its system and the four (4) control pads and the four (4) vehicles in the other systems configured in this embodiment.

The expanded system including the microcomputers 94 and 94*a* may be adapted so that the address and data signals generated in the microcomputer 94*a* may be transmitted by the antenna 68 in the central control station 64 when the central control station 64 serves as the master station. The operation of the central control station 64*a* may be clocked by the signals extending through a line 118 from the central control station 64 to the adaptor 115 and through a corresponding line from the other central control station to the adaptor.

The microcontroller 122 of the vehicle 12 (FIG. 4) includes a read only memory (ROM) 124 and a random access memory (RAM) 126. As with the memories in the control pad 42*a* and the central control station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

Figure 4:
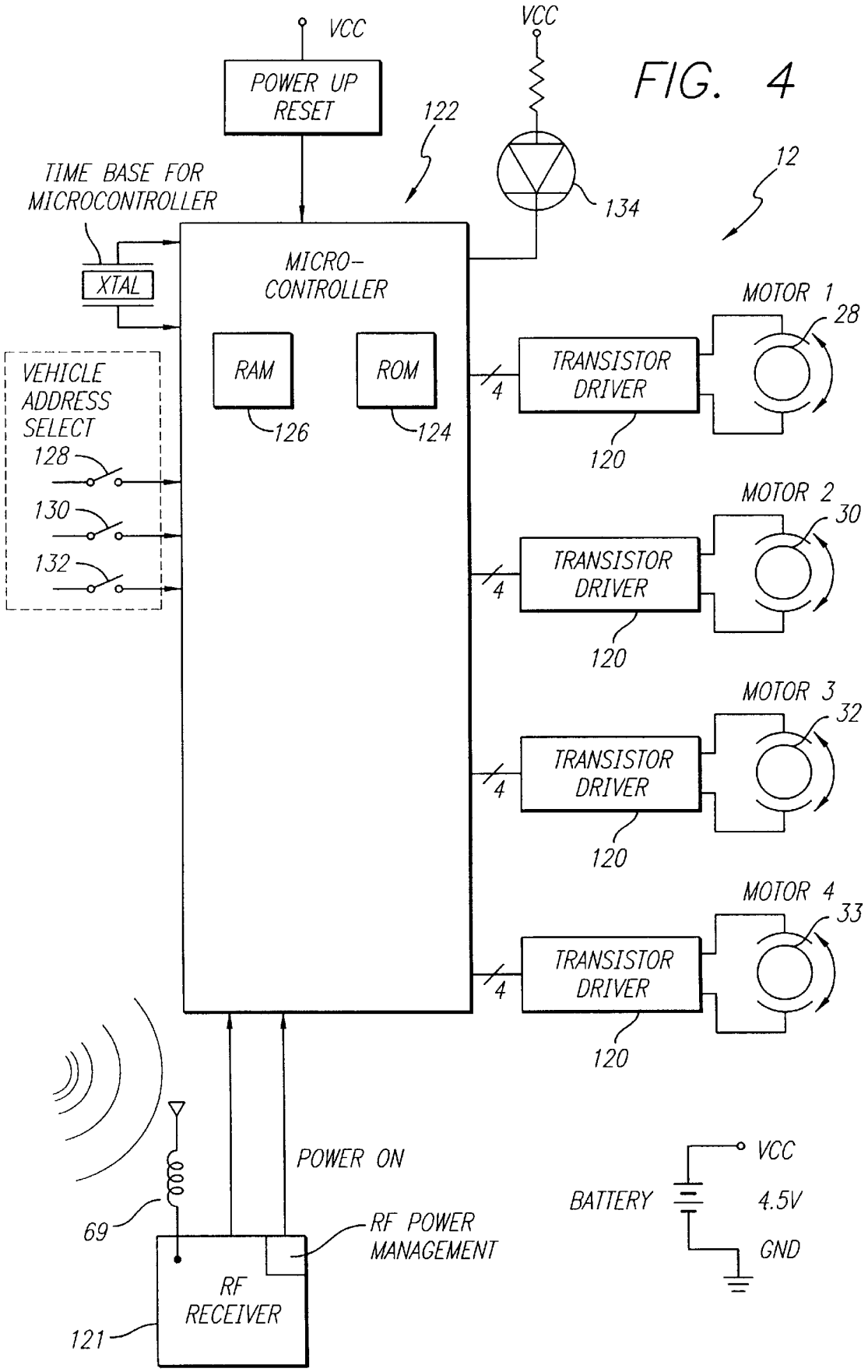
FIG. 4 is a schematic diagram, primarily in block form, of the different features in a vehicle included in the system shown in FIG. 1.

The particular embodiment reflected by vehicle 12 includes a plurality of switches 128, 130 and 132 (FIG. 4). These switches are generally pre-set at the factory to indicate a particular Arabian number such as the number "5". However, the number can be modified by the user to indicate a different number if two central control stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17. Additional switches similar to the switches 128, 130 and 132 and configured to work in cooperation with such switches may be added to the vehicles to accommodate addressing of larger numbers of vehicles so that each may have its own unique address.

The pattern of closure of the switches 128, 130 and 132 in one of the vehicles can be changed when there is only a single central control station. For example, the pattern of closure of the switches 128, 130 and 132 can be changed when there is only a single central control station with a vehicle identified by the numeral "5" and when another user brings to the central control station, from such other user's system, another vehicle identified by the numeral "5".

The vehicle 12 also includes a light such as a light emitting diode 134. This diode is illuminated when the vehicle 12 is selected by one of the control pads 42*a*, 42*b*, 42*c* and 42*d*. In this way, the other users can see that the vehicle 12 has been selected by one of the control pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously described, the user of one of the control pads such as the control pad 42*a* selects the vehicle 12 by successively depressing the button 58 a particular number of times within a particular time period. This causes the central control station 64 to produce an address identifying the vehicle 12. When this occurs, the central control station 64 stores information in its random access memory 98 that the control pad 42*a* has selected the vehicle 12. Because of this, the user of the control pad 42*a* does not thereafter have to depress the button 58 during the time that the control pad 42*a* is directing commands through the station 64 to the vehicle 12. As long as the buttons on the control pad 42*a* are depressed within a particular period of time to command the vehicle 12 to perform individual functions, the microprocessor 94 in the central control station 64 will direct the address of the vehicle 12 to be retrieved from the read only memory 96 and to be included in the packet of the signals transmitted by the central control station to the vehicle 12.

The read only memory 96 in the microprocessor 94 at the central control station 64 stores information indicating a particular period of time in which the vehicle 12 has to be addressed by the control pad 42*a* in order for the selective coupling between the control pad and the vehicle to be maintained. The random access memory 98 in the microcontroller 94 stores the elapsed period of time from the last time that the control pad 42*a* has issued a command through the central control station 64 to the vehicle 12. When the period of time in the random access memory 98 equals the period of time in the read only memory 96, the microcontroller 94 will no longer direct commands from the control pad 42*a* to the vehicle 12 unless the user of the control pad 42*a* again depresses the button 58 the correct number of times within the particular period of time to select the vehicle 12.

The vehicle 12 also stores in the read only memory 124 indications of the particular period of time in which the vehicle 12 has to be addressed by the control pad 42*a* in order for the selective coupling between the vehicle and the control pad to be maintained. This period of time is the same as the period of time specified in the previous paragraph. The random access memory 126 in the microcontroller 122 stores the elapsed period of time from the last time that the control pad 42*a* has issued a command to the vehicle 12.

Once the particular button 58 of particular pad has been actuated to select and energize a vehicle, that vehicle remains operative and associated with such particular pad for a predetermined period of time as dictated by random access memory 126. When the elapsed period of time stored in the random access memory 126 of the microcomputer 122 in the vehicle equals the period of time in the read only memory 124, the microcontroller 122 issues a command to extinguish the light emitting diode 134. This indicates to the different users of the system, including the user previously controlling the operation of the vehicle 12 that the vehicle is available to be selected by any one of the users, including the user previously directing the operation of that vehicle.

When one of the vehicles such as the vehicle 12 is being moved in the forward direction, the random access memory 126 records the period of time during which such forward movement of the vehicle 12 is continuously occurring. This count is continuously compared in the microcontroller 122 with a fixed period of time recorded in the read only memory 124. When the period of time accumulated in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a cooperative basis. Furthermore, the vehicles can be operated on a flexible basis in that a vehicle can be initially selected for operation by one user and can then be selected for operation by another user after the one user has failed to operate the vehicle for a particular elapsed period of time. The vehicles being operated at each instant are also visible by the illumination of the lights 134. The apparatus and method of this invention are also advantageous in that the vehicles are operated by the central control station 64 on a wireless basis without any physical or cable connection between the central control station and the vehicles.

Furthermore, the central control station 64 communicates with the vehicles in the plurality through a single carrier frequency. The system and method of this invention are also advantageous in that the vehicles can selectively perform a number of different functions including forwardly and rearwardly movement, as well as turns to the left and to the right, and manipulation of accessories such as containers, bins or platforms carried on the respective vehicles. Different movements can also be provided simultaneously on a coordinated basis. Vehicles may also be employed in a cooperative manner to work with stationary plants and accessories 34 and 38 for the movement and storage of materials such as blocks 24 and marbles 26.

Figure 5A:
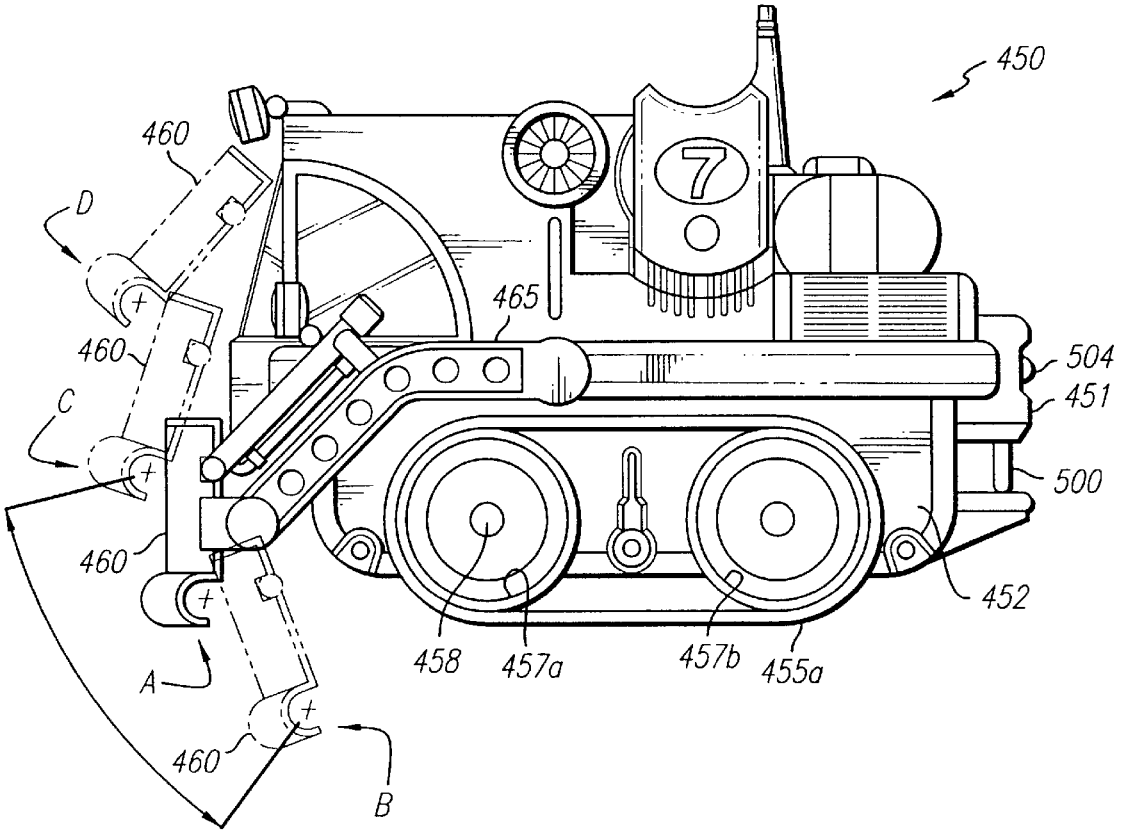
FIG. 5A depicts an embodiment of a toy bulldozer which incorporates a free-floating blade assembly.
Figure 5B:
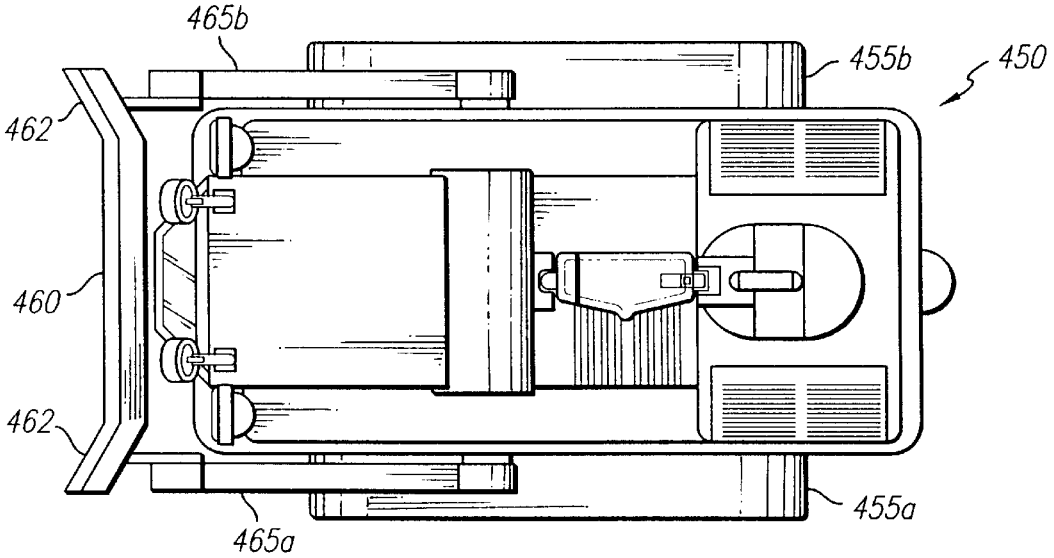
FIG. 5B is a top view of the toy bulldozer shown in FIG. 5A.

Referring now to FIG. 5A, a toy bulldozer 450 incorporating aspects of the present invention is shown. The bulldozer 450 includes a chassis 452 having a front and rear end, a pair of front and rear wheels 457*a* and 457*b* driven by a left side drive motor 28 (FIG. 4) and independently mounted on the left side of the bulldozer 450 on axles mounted to the chassis. A pair of front and rear wheels are mounted in a similar fashion on the right side of the bulldozer 450 and are driven by a right side drive motor 30 (FIG. 4). A track 455*a* is disposed around the front and rear wheels 457*a* and 457*b* on the left side of the bulldozer 450, and another track 455b is disposed around the front and rear wheels mounted on the right side of the bulldozer 450.

Figure 6:
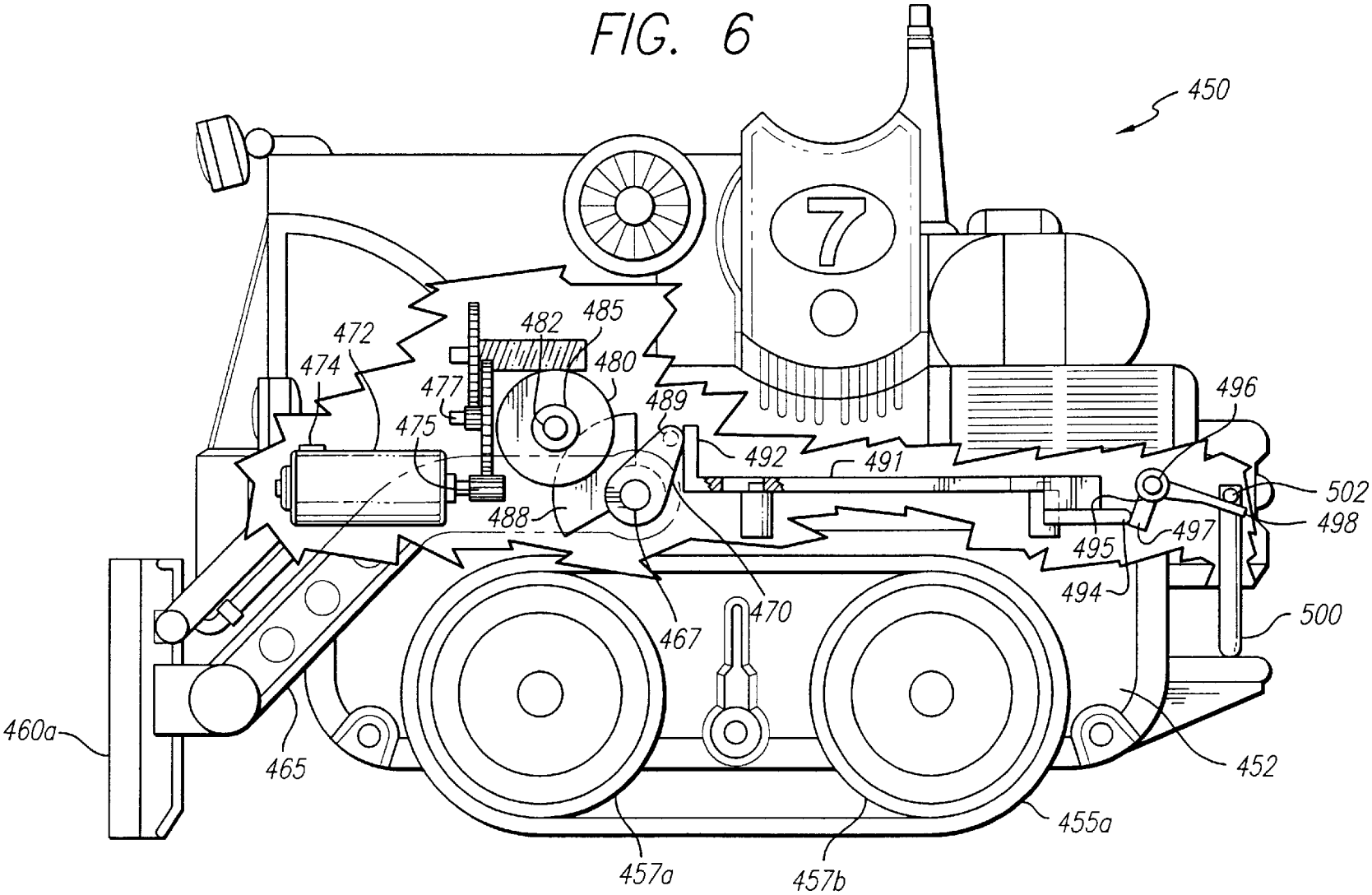
FIG. 6 is a partial, cross-sectional view of an embodiment of the blade lift and hitch pin actuation assembly for the toy bulldozer of FIG. 5A.

The bulldozer 450 also includes left and right arms 465*a* and 465*b* pivotally mounted at their rear extremity to a transverse lift shaft 467 rotatably mounted on the chassis 452 (FIG. 6). A pusher blade 460 is mounted at a forward end of the pair of arms 465*a* and 465*b*. The arms 465*a* and 465*b* are positioned on the left and right sides of the bulldozer, respectively, and are fixedly mounted to right and left extending ends of the shaft 467. The blade 460 includes laterally disposed forwardly and outwardly angled edge retainer wings 462.

A hitch assembly 451 is mounted to the rear of the chassis 452. The hitch assembly 451 includes a hitch pin that may be opened and closed to allow attachment of a miniature cable or trailer tongue.

Figure 7:
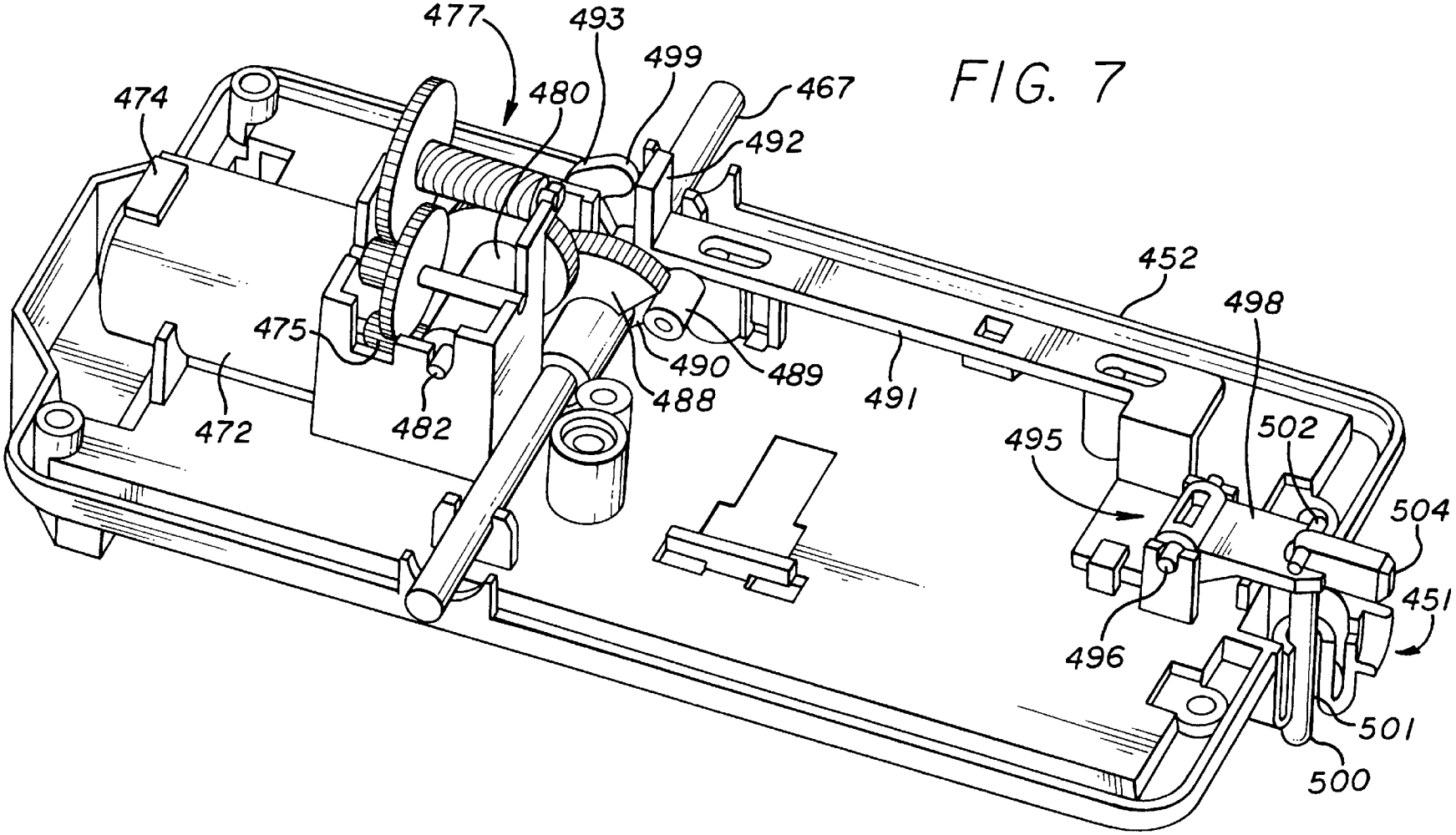
FIG. 7 is a perspective view, partly in cross-section, of the chassis of the bulldozer of FIG. 5A showing the detailed arrangement of the elements of the blade lift and hitch pin actuation assembly of FIG. 6.
Figure 8:
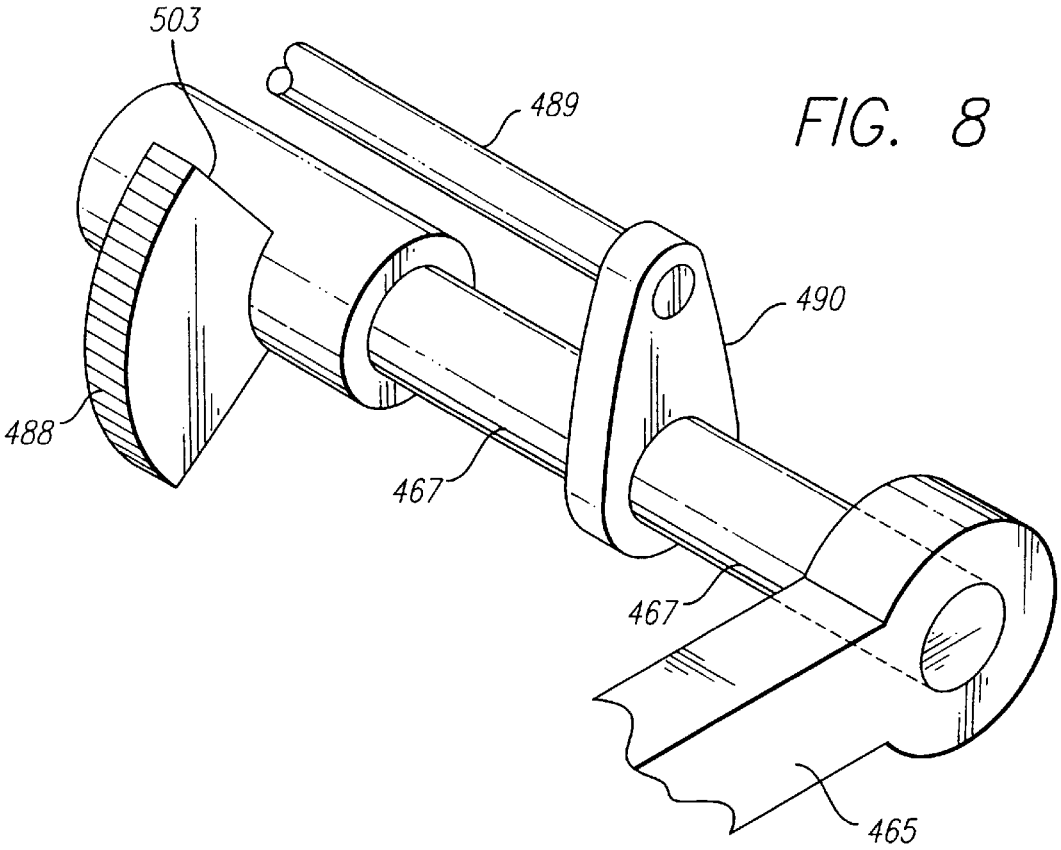
FIG. 8 is an enlarged perspective view of a portion of the blade lift and hitch pin actuation assembly of FIGS. 6 and 7.

Referring to FIGS. 6–8, the details of the mechanical assembly of one embodiment of the lost motion device of the present invention is described. A drive motor 472 having a transistor driver 474, both of which are similar in design and function to the motor 32 and driver 120 respectively depicted in FIG. 4, is mounted to the chassis 452. The motor 472 includes a rotating shaft upon which is mounted a pinion gear 475. The pinion gear 475 is engaged with a reduction gear assembly 477. The output gear of the reduction gear assembly 477 is meshed with a clutch gear 480 mounted on a shaft 482 rotatably mounted to the chassis 452. The clutch gear 480 is engaged with a pinion gear 485 (FIG. 6). A sector gear 488 is rotatably mounted to the shaft 467 such that the sector gear rotates independently from the shaft 467. A bell crank 490 is fixedly mounted at one end to the shaft 467. A pin 489 is mounted to the other end of the bell crank 490 and extends inwardly into the path of the rotation of the sector gear 488 (FIGS. 7–8). A cam 493 having a strike face 499 is also fixedly mounted to the shaft 467.

An elongated pusher bar 491 is slidably mounted on the chassis 452 (FIG. 7). The elongated pusher bar 491 has an upstanding follower arm 492 formed on a forward end of the elongated pusher bar 491 and is disposed in the path of the strike face 499 of the cam 493 mounted on the shaft 467. The elongated pusher bar 491 also has a rearward end configured to actuated a hitch lift lever 495.

As depicted in FIG. 6, the lift lever 495 is generally T-shaped, having a pusher arm 497 disposed on a forward end and a hitch lifter arm 498 disposed on a rearward end. The lift lever 495 is rotatably mounted on a pivot pin 496 mounted to the chassis 452 such that rearward movement of the pusher arm 497 results in upwards movement of the lifter arm 498.

The hitch pin assembly 451 mounted at the rear of the chassis 452 includes a vertical channel 501 for the receiving a hitch pin 500 sized to move freely in a generally upwards and downwards manner within the vertical channel 501. A lifter tab 502 is formed on an upper end of the hitch pin 500. The hitch pin 500 also includes a finger tab 504 projecting rearwardly through a slot formed in the hitch pin assembly 451 for manually lifting the hitch pin.

The operation of the embodiment of the lost motion device described above will now be described with reference to FIGS. 5A, 6, 7 and 8. When the bulldozer 450 is being operated on a surface with the blade 460 in contact with the surface, the blade is in position A (FIG. 5A), hereinafter called the neutral position. When the blade 460 is in the neutral position, the lost motion device described above allows the blade 460 to freely float upwards and downwards so that the blade 460 may follow the contour of a surface as the bulldozer traverses the surface. The blade may, for example, freely float upwards twenty (20) degrees from the neutral position and float downwards twenty (20) degrees from the neutral position. When the operator of the bulldozer 450 commands the bulldozer 450 to lift the blade 460, the motor 472 (FIG. 7) is controlled to drive the sector gear 488 in a clockwise direction. Because the sector gear 488 is rotatably mounted about the shaft 467, the sector gear 488 may rotate through a selected arc, for example, twenty degrees, without lifting the lift arm 465. When the sector gear 488 has rotated in the clockwise direction a sufficient number of degrees, for example, twenty degrees, the forward face 503 of the sector gear 488 engages the pin 489 mounted to the bell crank 490. Since the bell crank 490 is fixedly mounted to the shaft 467, as is the lift arm 465, continued clockwise rotation of the sector gear 488 causes the bell crank 490, shaft 467 and the lift arm 465 to rotate in a clockwise direction, lifting the lift arm 465 and the blade 460.

The operator of the bulldozer 450 may continue to control the motor 472 to rotate the sector gear 488 in a clockwise direction, lifting the lift arm 465 further and, after the sector gear 488 has rotated through a further arc, for example, an additional twenty degrees, the strike face 499 of the cam 493 contacts the upstanding follower arm 492 of the elongated pusher bar 491. Further clockwise rotation of the sector gear 488 causes the cam 493 to push the elongated pusher bar 491 in a rearwardly direction such that the end 494 of the elongated pusher bar pushes against the pusher arm 497 of the hitch lever 495, pivoting the hitch lever 495 about the shaft 496. As the hitch lever 495 pivots in response to the rearwards pressure from the end 494 of the elongated pusher bar 491, the hitch lifter arm 498 moves upwards, exerting upwards pressure on the lifter tab 502 of the hitch pin 500, raising the hitch pin 500 and opening the hitch.

Similarly, when the blade 460 and the hitch pin 500 are already in a raised position, such as position C shown in Figure 5A, the operator may control the motor 472 (FIG. 7) to drive the sector gear 488 in the counterclockwise direction to lower the blade 460 and the hitch pin 500. As the sector gear 488 rotates counterclockwise, the weight of the blade 460 and the lift arm 465 maintains the pin 489 in contact with the forward face 503 of the sector gear 488. Similarly, the weight of the hitch pin 500 maintains downward pressure on the hitch lift lever arm 498. The downward pressure on the hitch lever arm 498 causes the pusher arm 497 to exert forwards pressure on the end 494 of the elongated pusher bar 491, maintaining the upstanding follower arm 492 of the elongated pusher bar 491 in contact with the strike face 499 of the cam 493. Alternatively, the elongated pusher bar 491 may be biased in the forward direction by a spring (not shown).

When the sector gear 488 has rotated through a sufficient arc, for example, twenty degrees, the elongated pusher bar 491 may reach the limits of allowable forward movement. Further counterclockwise rotation of the sector gear 488 disengages the cam 493 from the upstanding follower arm 492. Additional counterclockwise rotation of the sector gear 488 will continue to lower the lift arm 465 until the blade 460 comes into contact with the surface upon which the bulldozer 450 is operating. Additional counterclockwise rotation of the sector gear 488 will not cause any additional lowering of the blade 460, as the sector gear 488 is rotatably mounted about the shaft 467. The sector gear 488 may be driven thru a further arc, for example, an additional twenty degrees, until further rotation is halted either mechanically or electronically. Such limitation may, for example, be accomplished with a mechanical stop or an electrical limit switch applied to the sector gear 488, or the motor 472 may be electronically limited such that it is automatically switched off when the shaft of the motor has rotated a selected number of rotations.

Figure 9:
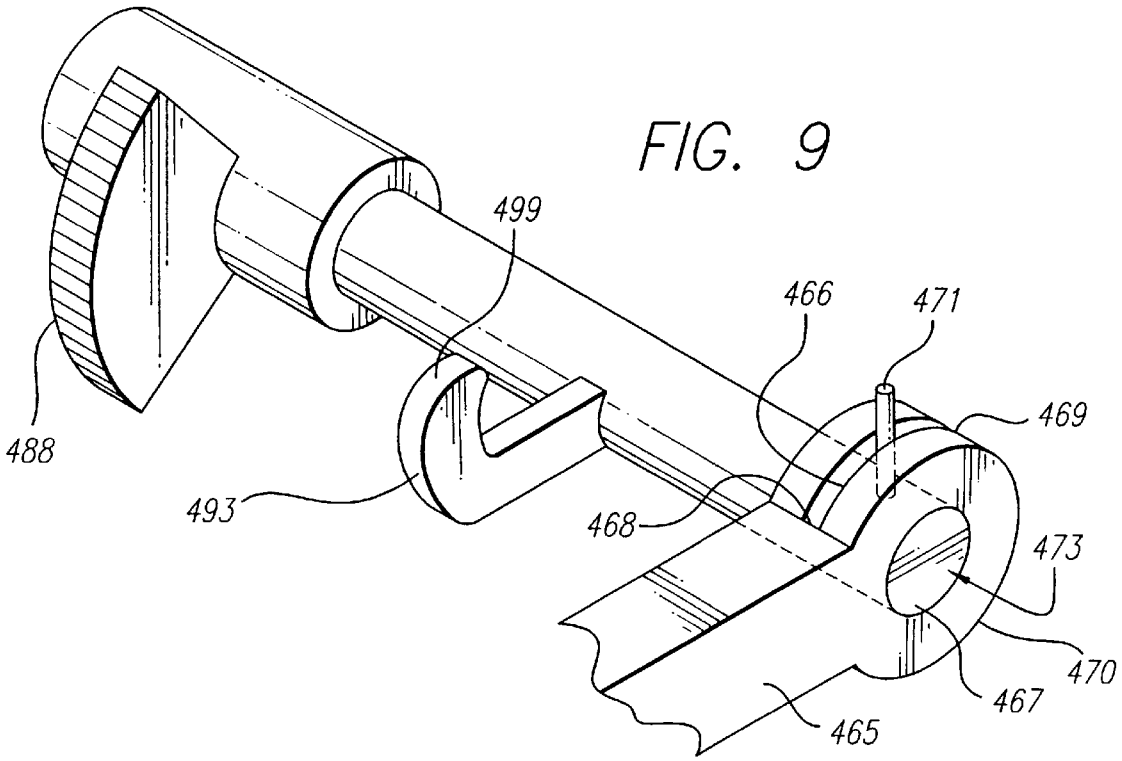
FIG. 9 is an enlarged perspective view of another embodiment of the blade lift and hitch pin actuation assembly of the toy bulldozer depicted in FIG. 5A.

Referring now to FIG. 9, another embodiment of the lost motion device is depicted. In this embodiment, the rearward end 470 of the lift arm 465 includes a slot 466 having forward and rearward ends 468 and 469 respectively, and extending radially through the rearward end 470 and in communication with the bore 473. The lift arm 465 is rotatably mounted on the shaft 467 by sliding the shaft 467 through the bore 473 of the rearward end 470 of the lift arm 465. A pin 471, fixed mounted to the shaft 467, extends radially outward from the shaft 467 and through the slot 466. Since the lift arm 465 is rotatably mounted on the shaft 467, the arm is free to rotate upwardly and downwardly about the shaft 467. The upwards rotation of the lift arm 465 is limited when the forward end 468 of the slot 466 engages the pin 471. Similarly, the downwards rotation of the lift arm 465 about the shaft 467 is limited when the rearward end 469 of the slot 466 engages the pin 471. The length of slot 466, that is, the distance between the forward end 468 and the rearward end 469 of the slot 466, may, for example, be suitably sized to provide twenty degrees of upwards rotation and twenty degrees of downwards rotation about the shaft 467 when the motor has driven the sector gear 488 such that the shaft 467 is in the neutral position.

As described above, the sector gear 488 may also be driven by the motor 472 (FIG. 7) to raise the lift arm 465. When the motor 472 is controlled to rotate so that the sector gear and the shaft 467 rotate in a clockwise direction, the pin 471, rotating with the shaft 467, will be driven towards the rearward end 469 of the slot 466. Until pin 471 is driven against the rearward end 469 of the slot 466 by the clockwise rotation of the shaft 467, the lift arm 465, being rotatably mounted about the shaft 467, will not move upwards. Once the pin 471 engages the rearward end 469 of the slot 466, further clockwise rotation of the shaft 467 and the pin 471 will cause the lift arm 465 to rotate in a clockwise direction, raising the lift arm 465. When the lift arm 465 is already in a raised position, such as depicted by position C in FIG. 5A controlling the motor 472 to lower the lift arm 465 will cause the motor to drive the sector gear 488 and the shaft 467 in the clockwise direction. Because the blade 460 is attached to the lift arm 465, the weight of the blade 460 maintains the rearward end 469 of the slot 466 in engagement with the pin 471 until the blade 460 contacts the surface on which the bulldozer 450 is operating. Thus, the blade may be controllably lowered by controlling the motor 472. When the blade 460 contacts the surface on which the bulldozer 450 is operating, further counterclockwise rotation of the sector gear 488 and the shaft 467 does not cause any downward pressure on the lift arm 465 because the pin 471 rotates out of engagement with the rearward end 469 of the slot 466. The sector gear 488 or the motor 472 may be electronically or mechanically limited so that the counterclockwise rotation of the sector gear 488 and the shaft 467 is halted when the pin 471 is approximately equidistant from the forward end 468 and rearward end 469 of the slot 466, thus placing the lift arm 465 in the neutral position.

It should be apparent from the above discussion that the two embodiments described each have particular advantages and disadvantages. In the embodiment of the invention depicted in FIG. 8, the lift arm 465 and the sector gear 488 rotate independently from each other unless the face 503 of the sector gear 488 is in contact with the pin 489. Even when in pin 489 is in contact with the face 503, the arm 465 may still be manually raised, limited only by the clearance between the lift arm 465 and the chassis 452. In contrast, the range of motion of the lift arm 465 in the second embodiment is determined by the length of the slot 466 shown in FIG. 9. This arrangement is advantageous in that downward pressure may be applied on the lift arm 465 by the motor 472, unlike the embodiment depicted in FIG. 8. However, while the embodiment illustrated by FIG. 8 allows actuation of the hitch pin independent of the elevation of the blade 460, such actuation may be prevented in the embodiment of FIG. 9 because the manual elevation of the blade will be limited by the position of the pin 471 relative to the forward end 468 of the slot 466. Unless the pin 471 has been rotated clockwise sufficiently, the forward end 468 of the slot 466 in the lift arm 465 will contact the pin 471, limiting the clockwise rotation of the lift arm 465 before the cam 493 has been rotated sufficiently to engage the upstanding forward end 492 of the elongated pusher arm 491.

In operation, the blade 460 and the arms 465*a* and 465*b* function in a free-floating manner to push materials such as the blocks 24 or the marbles 26 in front of the blade 460 as the bulldozer 450 traverses over a surface. While traversing over a surface, the retainers 462 operate to prevent transportable elements or materials previously captured by the blade 460 from escaping around either edge of the blade 460.

Figure 10:
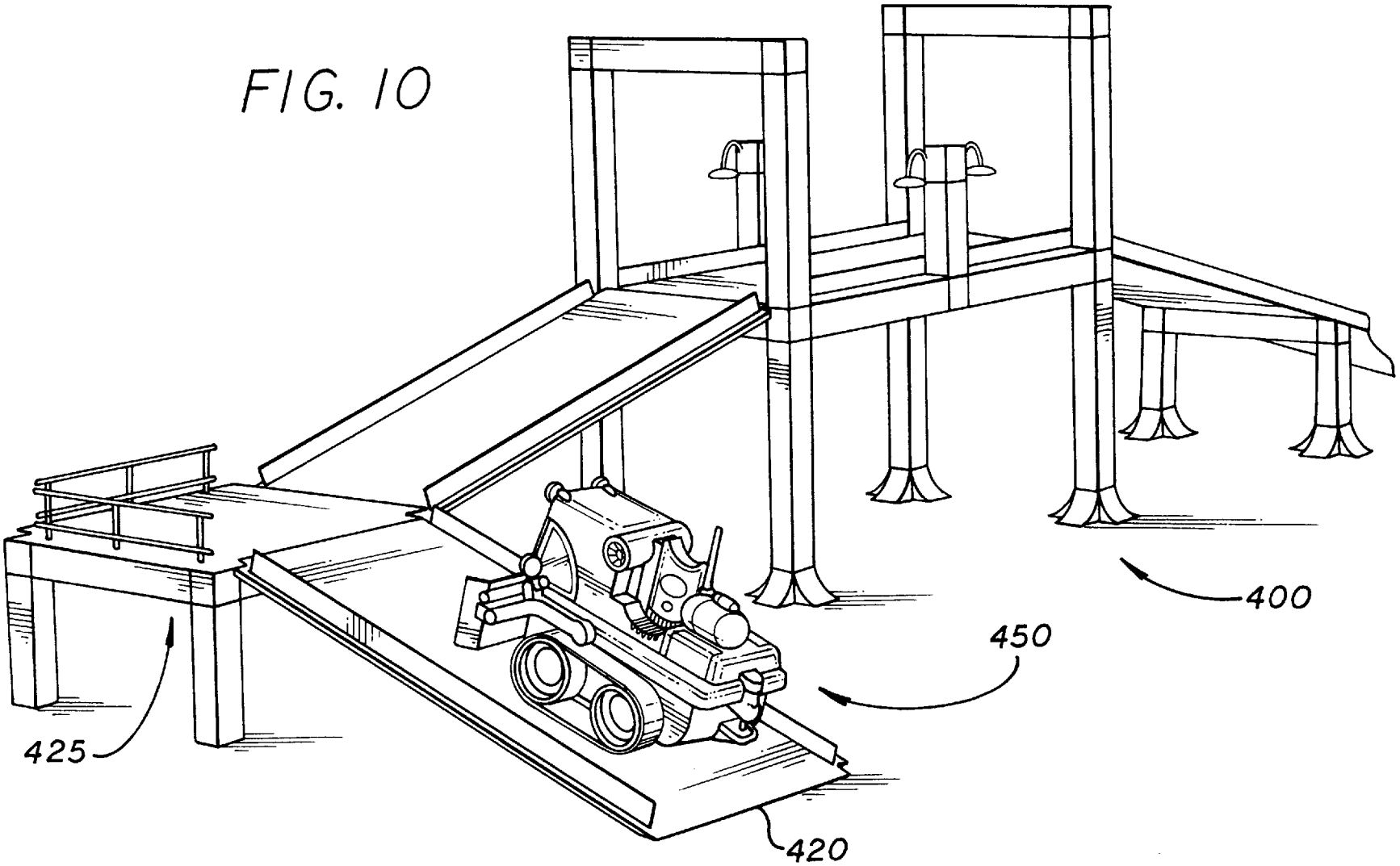
FIG. 10 is a side view of a ramped structure accessory illustrating the play environment showing a toy bulldozer ascending a series of ramps and platforms before crossing a bridge.

As is illustrated by FIG. 10, various model environments can be constructed to provide for intriguing and enjoyable play by persons of youthful minds. Such model environments, however, may constrain the design and function of the vehicles 12, 14, 16, 17 and 450 so that the vehicles may be easily operated within the environment. For example, a ramped and elevated platform structure, generally indicated at 400, is accessed by the toy bulldozer 450 by ascending an inclined ramp shown. As the bulldozer 450 approaches the inclined ramp 420, the blade 460 is pushed into contact with the lower terminus of the ramp 420. Because the lift arms 465 to which the blade 460 is attached are free to float with respect to the sector gear 488 when the blade 460 is in the neutral position as in position A in FIG. 5A, the blade 460 may ride up and over the threshold of the ramp 420. If the blade 460 was not able to float freely with respect to the sector gear 488, the blade 460 would jam against the inclined ramp 460, stopping the forward movement of the bulldozer 450.

Similarly, when the blade 460 approaches the upper end of the ramp 420, there is a period of time when the bulldozer 450 remains on the inclined ramp 420 and the blade 460 extends beyond the upper end of the ramp 420 and above the intermediate platform 425. If the blade 460 cannot float downwards, any material being pushed by the blade 460 may escape the blade 460. However, the embodiments of the lost motion device described above provide for downward rotation of the lift arm 465, and thus the blade 460, independent of the sector gear 488, thus allowing the blade 460 to float downwards as it passes over the upper end of the inclined ramp 420 onto the intermediate platform 425.

The operator may raise the blade 460 above the surface being traversed by the bulldozer 450 to provide a gap below the bottom horizontal edge of the blade 460. Granular work material or transportable elements being pushed in front of the blade 460 may thus pass under the gap and be spread about the surface being traversed by the bulldozer 450 thereby providing a grading action. It will be apparent from the above description of the lost motion embodiments of the present invention that while the blade 460 may be maintained in an elevated position, the blade is still capable of freely floating upwards if an obstacle is encountered.

Similarly, when the embodiment of the lost motion device depicted in FIG. 9 is incorporated into the bulldozer 450, the blade may be raised, and then lowered onto a pile of pile of granular material that prevents the blade from returning to the level, neutral position depicted by position A in FIG. 5A. In this case, the sector gear 488 may be rotated in a counterclockwise direction until pin 471 engages the forward end 468 of the slot 466. Continued counterclockwise rotation of the sector gear 488 will push pin 471 against the forward end 468 of the slot 466, placing downward pressure upon the lift arm 465 and thus the blade 460. In this manner, the operator may control the bulldozer 450 in an enjoyable manner to simulate actual operation of a bulldozer with a high degree of realism.

While several forms of the invention have been illustrated and described, it will also be apparent that various modifications can be made without departing from the spirit and scope of the invention. Accordingly, it is not intended that the invention be limited, except by the appended claims.

We claim:

1. In combination:

a set of wheels;

a toy bulldozer body carried on the set of wheels;

a pivot shaft;

a blade;

an elongated blade lift arm device carried from said body at its rear extremity by the pivot shaft and having a forward extremity carrying the blade, said arm pivotable for travel from a lowermost position through a free float arc upwardly through a contouring arc;

a drive pinion;

a drive motor on said body for selectively rotating the drive pinion in lifting and lowering directions to lift and lower said arm device;

a drive device coupled to said pinion and arm device and operative to drivingly disengage said arm device as said motor advances a predetermined amount to a selected point in said lifting direction to free said arm device to float through said float arc and further operable in response to said motor continuing to advance beyond said selected point in said lifting direction to drivingly engage said arm device and lift said arm device to said contouring arc.

2. In combination with claim 1 wherein:

said drive device is coupled with said pivot shaft and includes a driver pinion disposed in spaced relationship with said shaft; and a sector gear fixedly mounted on said shaft and formed with a geared periphery configured to rotate with said shaft in a circular path to remain disengaged from said driver pinion as said blade lift arm device is rotated upwardly through said float arc and to, as said blade lift arm device is rotated upwardly beyond said driver float arc, drivingly engage said pinion.

3. In combination with claim 1 that includes:

a hitch pin;

a hitch pin mount movable between hitching and unhitching positions and movably mounting said hitch pin from said body for movement between the hitching and unhitching positions;

a kicker pivotally carried from said body and pivotal from a latching position to an unlatching position to engage said hitch pin and move the hitch pin to the unhitching position; and a driver device carried from said pivot shaft and operable in response to said arm device being raised through said contouring arc to pivot said kicker to said unlatching position and to shift said hitching pin to said unhitching position.

4. In combination with claim 3 wherein:

said driver device includes a cam mounted on said pivot shaft.

5. In combination with claim 4 wherein:

said driver device includes a slider carried slidably from said body for translation relative thereto and drivingly interposed between said cam and kicker.

6. In combination with claim 1 that includes:

tracks on said wheels having respective lower surfaces disposed in a selected horizontal plane and wherein:

the blade has a bottom edge and wherein:

said drive device is operative, when said lift arm device is rotated downwardly sufficiently to locate the bottom edge of said blade below the horizontal plane, to drivingly disengage said lift arm device.

7. In combination:

a toy bulldozer including a laterally projecting rotatable arm lift shaft;

a lift arm device rotatably carried on its rear extremity from said shaft and projecting forwardly to mount a blade;

a drive motor constructed to become activated in first and second opposite directions for rotating said shaft;

a lost motion device interposed between said motor and said shaft and operable in response to activation of said motor in the first direction to provide for rotation of said lift arm device through a predetermined arc relative to said shaft and to then, with continued activation of said motor in the first direction, rotate said lift arm device with said shaft, and members operatively coupled to the lost motion device for providing a rotation of the lost motion device relative to the shaft at first times and a rotation of the lost motion device with the shaft at second times.

8. In combination for use with transportable elements, a movable vehicle, the vehicle including a chassis, wheels on the chassis for providing a movement of the vehicle, a pair of arms mounted on the chassis for upward and downward movement, a blade supported by the arms for moving the transportable elements in accordance with the movements of the vehicle, motor means for driving the wheels to move the vehicle, a drive device operatively coupled to the arms and having first and second operative relationships and operative in the first relationship to provide for a free floating disposition of the blade and the arms between a first level of the blade above a ground level and a second level of the blade below the ground level and operative in the second relationship to drive the arms and the blade to a position of the blade between the first and second levels, a shaft, a sector gear disposed on the shaft for rotation by the motor, one of the sector gear and the arms being freely rotatable on the shaft and the other of the sector gear and the arms being disposed on the shaft for rotation with the shaft, and means for providing a lost motion coupling of the sector gear to the arms for the operation of the arms in the first relationship in accordance with the lost motion between the sector gear and the arms and for the operation of the arms in the second relationship in accordance with the coupling between the sector gear and the arms.

9. In combination for use with transportable elements, a movable vehicle, the vehicle including a chassis, wheels on the chassis for providing a movement of the vehicle, a pair of arms mounted on the chassis for upward and downward movement, a blade supported by the arms for moving the transportable elements in accordance with the movements of the vehicle, motor means for driving the wheels to move the vehicle, a drive device operatively coupled to the arms and having first and second operative relationships and operative in the first relationship to provide for a free floating disposition of the blade and the arms between a first level of the blade above a ground level and a second level of the blade below the ground level and operative in the second relationship to drive the arms and the blade to a position of the blade between the first and second levels, the vehicle being movable on a support surface and the drive device being constructed to provide for a pivotable displacement of the blade and the arms from the support surface in the first relationship of the blade and the arms when the slope of the support surface at the position of the blade is different from the slope of the support surface at the position of the wheels, the drive device including a driving member and a driven member and the driven member being disposed in a first relationship with the driving member in first positions of the driving member for the operation of the arms and the blade in the first relationship and the driven member being disposed in a second relationship with the driving member in second positions of the driving member for the operation of the arms and the blade in the second relationship and wherein a shaft, a sector gear disposed on the shaft for rotation by the motor means and wherein one of the sector gear and the arms being freely rotatable on the shaft and the other of the sector gear and the arms being disposed on the shaft for rotation with the shaft, and means for providing a lost motion coupling of the sector gear to the arms for the operation of the arms in the first relationship in accordance with the lost motion between the sector gear and the arms and for the operation of the arms in the second relationship in accordance with the coupling between the sector gear and the arms.

10. In combination for providing transportable elements at a particular level above a support surface, a movable vehicle, the vehicle including a chassis having opposite lateral sides, wheels on the chassis for providing a movement of the vehicle, a pair of arms mounted on the chassis on the opposite lateral sides of the chassis for movement upwardly and downwardly relative to the chassis, a blade supported by the arms for moving the transportable elements in accordance with the movements of the vehicle, a motor for driving the arms upwardly and downwardly, and a drive device operatively coupled to the arms and the motor for setting the blade at a particular level to provide for the leveling of the transportable elements at the particular level of the blade and for providing for a free movement of the arms to raise the blade above an obstacle higher than the particular level of the blade and in the path of movement of the vehicle, the drive device providing a lost motion of the arms and the blade relative to the drive device to a position of the blade above the particular level and preventing a motion of the arms and the blade below the particular level even when the level of the transportable elements is below the particular level.

11. In a combination as set forth in claim 10, the particular level constituting a first particular level, the drive device being constructed to provide for a disposition of the blade at a second particular level corresponding to the level of the support surface and a free movement of the arms and the blade above and below the second particular level when the support surface rises above the second particular level or dips below the second particular level during the movement of the vehicle.

12. In combination for providing transportable elements at a particular level above a support surface, a movable vehicle, the vehicle including a chassis having opposite lateral sides, wheels on the chassis for providing a movement of the vehicle, a pair of arms mounted on the chassis on the opposite lateral sides of the chassis for movement upwardly and downwardly relative to the chassis, a blade supported by the arms for moving the transportable elements in accordance with the movements of the vehicle, a motor for driving the arms upwardly and downwardly, a drive device operatively coupled to the arms and the motor for setting the blade at a particular level to provide for the leveling of the transportable elements at the particular level of the blade and for providing for a free movement of the arms to raise the blade above an obstacle higher than the particular level of the blade and in the path of movement of the vehicle, and means coupled to the drive device for providing controlled movements of the arms and the blade upwardly after the free movement of the arms and the blade upwardly through a particular distance.

13. In combination for providing transportable elements at a particular level above a support surface, a movable vehicle, the vehicle including a chassis having opposite lateral sides, wheels on the chassis for providing a movement of the vehicle, a pair of arms mounted on the chassis on the opposite lateral sides of the chassis for movement upwardly and downwardly relative to the chassis, a blade supported by the arms for moving the transportable elements in accordance with the movements of the vehicle, a motor for driving the arms upwardly and downwardly, and a drive device operatively coupled to the arms and the motor for setting the blade at a particular level to provide for the leveling of the transportable elements at the particular level of the blade and for providing for a free movement of the arms to raise the blade above an obstacle higher than the particular level of the blade and in the path of movement of the vehicle, the drive device including a driving member and including a shaft and the arms being disposed on the shaft, one of the driving member and the arms being freely rotatable on the shaft and the other one of the driving member and the arms being fixedly disposed on the shaft.

14. In combination, a movable vehicle, the vehicle including a chassis having opposite lateral sides, wheels on the chassis for providing a movement of the vehicle, a pair of arms mounted on the chassis on the opposite lateral sides of the vehicle for movement upwardly and downwardly, a blade supported by the arms for movement in accordance with the movements of the arms, a motor for driving the arms upwardly and downwardly, a drive device including a first member constructed and disposed to provide a floating movement of the arms upwardly and downwardly, in accordance with the levels encountered by the blade, between a first particular level above a support surface for the vehicle and a second particular level below such support surface, and the drive device including second members operatively coupled to the motor and the first member for controllably driving the arms upwardly to any position between the support surface and the first particular level while providing for a continued downward floating of the arms and the blade in accordance with the changes in the level of the support surface during the movement of the vehicle.

15. In a combination as set forth in claim 14, a shaft, a coupling member driven by the motor and disposed on the shaft, the arms being rotatably mounted on the shaft and providing the lost motion, and the second members including a driven member mounted on the shaft and driven by the first member, after the completion of the lost motion, to drive the arms upwardly and downwardly.

16. In a combination as set forth in claim 14, the drive device including the second members being operative to drive the drive device upwardly beyond the first particular level of the blade, a hitch device including a hitch for coupling the hitch device to the vehicle in a first operative relationship and for uncoupling the hitch device from the vehicle in a second operative relationship, and a cam device operatively coupled to the drive device and responsive to the upward movement of the drive device beyond the first particular level of the arms for uncoupling the hitch device from the vehicle.

17. In combination for operation on a support surface, a movable vehicle, the vehicle including a chassis, wheels on the chassis for providing a movement of the vehicle on the support surface, motor means for rotating the wheels to obtain a movement of the vehicle on the support surface, a shaft mounted on the chassis, a pair of lift arms mounted on the shaft for pivotal movement of the lift arms upwardly and downwardly, a blade disposed on the lift arms opposite the shaft, first means associated with the lift arms for providing a floating pivotal movement of the lift arms upwardly and downwardly through particular distances in accordance with changes in the height of the support surface in front of the wheels during the movement of the vehicle on the support surface, and second means disposed in a cooperative relationship with the lift arms and the first means for providing a controlled pivotal movement of the lift arms upwardly and downwardly and for preventing floating pivotal movement downwardly when the lift arms are moved upwardly beyond a selected distance above the support surface.

18. In a combination as set forth in claim 17, the second means also being operative to provide a pivotal movement of the lift arms downwardly until the blade contacts the support surface.

19. In combination for operation on a support surface, a movable vehicle, the vehicle including a chassis, wheels on the chassis for providing a movement of the vehicle on the support surface, motor means for rotating the wheels to obtain a movement of the vehicle on the support surface, a shaft mounted on the chassis, a pair of lift arms mounted on the shaft for pivotable movement of the lift arms upwardly and downwardly, a blade disposed on the lift arms opposite the shaft, first means associated with the lift arms for providing a floating pivotable movement of the lift arms upwardly through a first distance and downwardly through a second distance in accordance with changes in the height of the support surface during the movement of the vehicle on the support surface, second means disposed in a cooperative relationship with the lift arms and the first means for providing a controlled pivotable movement of the lift arms upwardly, a hitch device including a hitch disposed relative to the hitch device and movable in a first direction for hitching the hitch device to the vehicle and movable in a second direction opposite to the first direction for unhitching the hitch device from the vehicle, and a device operatively coupled to the second means and responsive to the upward pivotable movement of the lift arms for moving the hitch in the first direction to unhitch the hitch device from the vehicle.

20. In combination for operation on a support surface, a movable vehicle, the vehicle including a chassis, wheels on the chassis for providing a movement of the vehicle on the support surface, motor means for rotating the wheels to obtain a movement of the vehicle on the support surface, a shaft mounted on the chassis, a pair of lift arms mounted on the shaft for pivotable movement of the lift arms upwardly and downwardly, a blade disposed on the lift arms opposite the shaft, first means associated with the lift arms for providing a floating pivotable movement of the lift arms upwardly through a first distance and downwardly through a second distance in accordance with changes in the height of the support surface during the movement of the vehicle on the support surface, and second means disposed in a cooperative relationship with the lift arms and the first means for providing a controlled pivotable movement of the lift arms upwardly, the first means including a member disposed on the shaft and freely movable, in accordance with changes in the height of the support surface at the position of the blade during the movement of the vehicle on the support surface, through first positions providing for the floating pivotable movement of the lift arms upwardly through the first distance and freely movable, in accordance with changes in the height of the support surface at the position of the blade during the movement of the vehicle on the support surface, through second positions providing for the floating pivotal movement of the lift arms downwardly through the second distance.

21. In a combination as set forth in claim 20, one of the member and the lift arms being freely rotatable on the shaft and the other of the member and the lift arms being fixedly disposed on the shaft, and a blade disposed on the ends of the lift arms opposite the shaft.

22. In a combination as set forth in claim 21, the second means also being operative to provide a pivotal movement of the lift arms downwardly until the blade contacts the support surface, a hitch device including a hitch disposed relative to the hitch device and movable in a first direction for hitching the hitch device to the vehicle and movable in a second direction opposite to the first direction for unhitching the hitch device from the vehicle, a cam device operatively coupled to the second means and responsive to the upward pivotable movement of the lift arms for moving the hitch in the second direction to unhitch the hitch device from the vehicle, the first means including a member disposed on the shaft and freely movable, in accordance with changes in the height of the support surface at the position of the blade during the movement of the vehicle on the support surface, through first positions providing for the floating pivotal movement of the lift arms upwardly through the first distance and freely movable, in accordance with changes in the height of the support surface at the position of the blade during the movement of the vehicle on the support surface, through second positions providing for the floating pivotal movement of the lift arms downwardly through the second distance.

23. In combination for operation on a support surface, a movable vehicle, the vehicle including a chassis, wheels on the chassis for providing a movement of the vehicle on the support surface, motor means for rotating the wheels to obtain a movement of the vehicle on the support surface, a shaft mounted on the chassis, a pair of lift arms mounted on the shaft for pivotal movement of the lift arms upwardly and downwardly, a blade on the lift arms at a position on the lift arms opposite the shaft, first means for setting the position of the blade to a particular level relative to the support surface, second means disposed relative to the first means for providing for a free pivotable movement of the lift arms and the blade upwardly through a particular distance from the particular level to provide for the blade to clear on the support surface obstacles having a height above the particular level during the movement of the vehicle on the support surface, and third means disposed relative to the first means for providing for a controlled movement of the lift arms and the blade upwardly and for preventing free pivotal movement of the lift arms and the blade downwardly when the lift arms and the blade have moved freely and pivotably upwardly through the particular distance.

24. In combination for operation on a support surface, a movable vehicle, the vehicle including a chassis, wheels on the chassis for providing a movement of the vehicle on the support surface, motor means for rotating the wheels to obtain a movement of the vehicle on the support surface, a shaft mounted on the chassis, a pair of lift arms mounted on the shaft for pivotable movement of the lift arms upwardly and downwardly, a blade on the lift arms at a position on the lift arms opposite the shaft, first means for setting the position of the blade to a particular level above the support surface, second means disposed relative to the first means for providing for a free pivotable movement of the lift arms and the blade upwardly from the particular level to clear obstacles on the support surface with a height above the particular level during the movement of the vehicle on the support surface, and a member disposed on the shaft, one of the member and the lift arms being freely pivotable on the shaft and the other of the member and the lift arms being fixedly disposed on the shaft, the member being disposed relative to the lift arms to provide for the free pivotable movement of the lift arms and the blade upwardly to clear on the support surface obstacles having a height above the particular level during the movement of the vehicle on the support surface.

25. In a combination as set forth in claim 24, a hitch device including a hitch movable in a first direction to couple the hitch device to the vehicle and movable in a second direction opposite to the first direction to uncouple the hitch device from the vehicle, and a device for moving the hitch in the hitch device in the second direction, during the pivotable movement of the lift arms upwardly beyond the particular position, to move the hitch in the second direction for uncoupling the hitch device form the vehicle.

26. In a combination as recited in claim 24, the member constituting a gear sector freely rotatable on the shaft, a drive device operatively coupled to the gear sector for rotating the gear sector, and a pin device disposed on the shaft relative to the gear sector for providing a free rotation of the lift arms and the blade upwardly through a distance for the blade to clear the obstacles on the support surface and to provide for the upward movement of the lift arms and the blade above the particular level.

27. In combination as set forth in claim 24, the member constituting a gear sector fixedly disposed on the shaft, a slot in each of the lift arms, and a pin fixedly mounted on the shaft and disposed in the slot for cooperating with the slot and the gear sector to provide for the free pivotable movement of the lift arms and the blade upwardly from the particular level through a distance for the blade to clear the obstacles on the support surface with the height above the particular level during the movement of the vehicle on the support surface.

* * * * *